US008022282B1

(12) United States Patent
Burns

(10) Patent No.: US 8,022,282 B1
(45) Date of Patent: Sep. 20, 2011

(54) BASEPLATE FOR USE WITH BASS DRUM

(76) Inventor: Nicholas R. Burns, Glendale, CA (US)

( * ) Notice: Subject to any disclaimer, the term of this patent is extended or adjusted under 35 U.S.C. 154(b) by 0 days.

(21) Appl. No.: 12/804,244

(22) Filed: Jul. 17, 2010

(51) Int. Cl.
*G10D 13/04* (2006.01)

(52) U.S. Cl. ..... 84/421

(58) Field of Classification Search ..... 84/411 R, 84/421, 422.1, 422.2, 422.3
See application file for complete search history.

(56) References Cited

U.S. PATENT DOCUMENTS

| | | | | |
|---|---|---|---|---|
| 2,919,618 | A * | 1/1960 | Slingerland, Jr. | 84/421 |
| 4,829,874 | A | 5/1989 | Hoshino | |
| 5,185,489 | A | 2/1993 | Hoshino | |
| 5,574,237 | A | 11/1996 | Yanagisawa | |
| 5,726,370 | A | 3/1998 | Yanagisawa | |
| 2006/0005689 | A1 | 1/2006 | Ito | |

OTHER PUBLICATIONS

Manufacturer DrumBum, drum beater assembly-to-bass drum connection Riser 1(1st example), catalog page discovered on World Wide Web.
Homemade drum beater assembly-to-bass drum connection Riser 2 (2nd example), discovered on World Wide Web.
Manufacturer Nodar Rode, drum beater assembly-to-bass drum connection Riser 3 (3rd example), catalog page discovered on World Wide Web.
Manufacturer Hoshino/Tama, drum beater assembly-to-bass drum connection Riser 4 (4th example), catalog page discovered on World Wide Web.
Manufacturer DW Drums, drum beater assembly-to-non-bass drum connection Cradle 1(1st example), catalog page discovered on world Wide Web.
Manufacturer Danmar Percussion, drum beater assembly-to-non-bass drum connection Cradle 2 (2nd example), catalog page discovered on World Wide Web.
Custom-made drum beater assembly-to-bass drum connecton Cradle 3 (3rd example), discovered on World Wide Web.
Manufacturer D'Amico Drums, drum beater assembly-to-bass drum connection Cradle, catalog page discovered on World Wide Web.
Custom-made drum cradle, drum beater assembly-to-bass drum connection Cradle, discovered on World Wide Web.
Custom-made Hoop Attachment, drum beater assembly-to-bass drum connection Hoop Attachment 1 (1st example), discovered on World Wide Web.

* cited by examiner

*Primary Examiner* — Kimberly Lockett
(74) *Attorney, Agent, or Firm* — John S. Christopher

(57) ABSTRACT

A baseplate, for use with a bass drum, including a center plate and a pair of wings extending outwardly therefrom. Each wing cradles and is adjustably secured to a lug affixed to a drum shell of a bass drum. A connection plate unitarily constructed with and extending from the center plate includes a terminal end with a lip for adjustably interfacing with a pedal clamp of a drum beater assembly for connecting the drum beater assembly to the bass drum. The pedal clamp is removably connectable to any point along the lip for laterally adjusting the striking point of a beater head onto the bass drum, the bass drum isolated from the pedal clamp for improving the resonance performance thereof, without changing the length of a beater shaft or the feel of the drum beater assembly.

13 Claims, 8 Drawing Sheets

BASEPLATE FOR USE WITH BASS DRUM

BACKGROUND OF THE INVENTION

1. Technical Field

The present invention relates to a bass drum. More specifically, the present invention relates to methods and apparatus for a baseplate for use in connecting a drum beater assembly to the bass drum, where the baseplate provides alternative connection points for the drum beater assembly to laterally adjust the striking point of a beater head on the bass drum, where the length of a beater shaft and the distance from the striking point to the drum center are independently adjustable, where the bass drum is isolated from a pedal clamp for improving the resonance performance of the bass drum without changing the length of the beater shaft or the feel of the drum beater assembly.

2. Background Art

Modern drum sets typically include a bass drum and a drum beater assembly for providing a percussion sound background to accompany other instruments during a musical performance. In very general terms, a bass drum includes a cylindrical drum shell typically comprised of plywood and open at each of a pair of ends of the drum shell. Extended over each of the pair of ends of the drum shell is a surface known as a drum head. Each drum head is tensioned and held in position over a bearing edge of the drum shell by a cylindrical drum hoop. The drum hoop traps the material comprising the drum head between the bearing edge of the drum shell and the drum hoop. The drum hoop is typically comprised of metal or wood and is held in position by a plurality of strategically located mechanical clamps each comprising an anchor lug affixed to the drum shell, an attachment claw that grips the distal end of the drum hoop, and a tension rod that connects the attachment claw to the anchor lug. Once properly tensioned and affixed in position, the drum head serves as the surface that is repeatedly struck for producing an acoustic output signal. A pair of spurs or stabilizing legs are affixed to the drum shell for balancing the bass drum during operation.

The typical drum set also includes the drum beater assembly which cooperates with the bass drum for producing the acoustic output signal. In general, the drum beater assembly includes a mounting platform having the rear end of a pedal board hinged thereto. The forward end of the pedal board is attached to a chain that is affixed to and meshes with a toothed gear mounted on a rotating arm. The chain and rotating arm are caused to rotate by applying a downward force to the pedal board and the required applied force is determined by an adjustable spring suspended between the rotating arm and the mounting platform. Mounted to the rotating arm is a beater shaft with a beater head affixed to the distal end of the beater shaft. Upon applying the appropriate downward force to the pedal board, the chain is drawn downward and the toothed gear is caused to rotate while the beater shaft and beater head are thrust forward.

In the conventional prior art bass drum, the drum beater assembly is directly physically connected to the bass drum in the following manner. Positioned on the mounting platform of the drum beater assembly is a pedal clamp which is used to capture the drum hoop of the bass drum. A gap exists between the pedal clamp and the mounting platform which forms a jaw. The size of the jaw is determined by an adjustment knob positioned on the mounting platform. By positioning the jaw of the pedal clamp over the drum hoop and tightening the adjustment knob, the drum beater assembly is directly physically connected to the bass drum. Because of this direct connection, it is noted that a portion of the acoustic output signal generated by striking the drum head of the bass drum is shunted away to the drum beater assembly. This action results in some distortion of the resultant acoustic output signal.

When the beater head is operated and made to strike the drum head of the bass drum, the acoustic output signal is generated. The location at which the beater head impacts the drum head of the bass drum is referred to as the "striking point". The drum head is generally circular in nature and can be viewed as a unit circle having a horizontal x-axis and a vertical y-axis which creates four quadrants. Each of the four quadrants is separated by ninety degrees from each adjacent quadrant which meet at the center of the drum head. That is, the intersection of the horizontal x-axis and the vertical y-axis is the center of the drum head (sometimes referred to as the drum head center). The determination as to which of the four quadrants the beater head strikes the drum head is a function of the x-y coordinates of the striking point. In the conventional bass drum arrangement, the pedal clamp is rigidly attached to the bottom of the curved drum hoop and thus the horizontal x-coordinate of the striking point is essentially fixed and cannot be adjusted. However, the vertical y-coordinate of the striking point can be adjusted by altering the length of the beater shaft. Thus, the range of striking points is limited to the locus of points along the y-axis coordinate (determined by the length of the beater shaft) and the essentially fixed x-axis coordinate (determined by the lowest point on the circumference of the drum hoop that the pedal clamp is rigidly attached to). Further, the x-y coordinates of the striking point of the beater head on the drum head of the bass drum determines the pitch and amplitude of the acoustic output signal.

Certain problems exist in the prior art bass drum connection arrangement to the drum beater assembly. These problems included the following. In the first instance, (1) there was no convenient lateral placement options available for the connection of the drum beater assembly to the bass drum. In the conventional connection arrangement, the pedal clamp of the drum beater assembly was directly connected to the lowest point on the circumference of the drum hoop of the bass drum. Although the pedal clamp was able to be moved somewhat along the bottom circumference of the drum hoop, that movement was limited and the x-axis coordinate was essentially constant. Consequently, the lateral placement options for connection of the drum beater assembly to the bass drum were limited. In order to significantly change the x-y coordinates of the striking point of the beater head on the drum head, the length of the beater shaft had to be adjusted. This adjustment, in effect, modified the y-axis coordinate of the striking point.

Second, (2) in the traditional drum beater assembly-to-bass drum connection arrangement, adjusting the length of the beater shaft inextricably changes the distance from the striking point of the beater head onto the drum head-to-the center of the drum head. Thus, these two parameters (i.e., length of beater shaft and the distance from the striking point-to-the center of the drum head) cannot be adjusted independent of one another in traditional coupler arrangements. Further, this adjustment causes multiple undesirable side affects. For example, it is noted that adjusting the length of the beater shaft affects the feel of the pedal board of the drum beater assembly which is unacceptable to some drum artists. Furthermore, changing the distance from the striking point of the beater head-to-the center of the drum head affects the characteristics of the acoustic output signal generated by the bass drum. In effect, when the length of the beater shaft is adjusted, the y-axis component of the x-y coordinates of the striking point of the beater head is changed. This y-axis modification causes the beater head to strike the drum head at a different location on the drum head which changes the pitch of the acoustic output signal. Third, (3) the drum hoop is often damaged when the pedal clamp of the drum beater assembly is physically attached to the drum hoop of the bass drum. When the jaws of the pedal clamp are clamped down on the drum hoop, the outer surface of the drum hoop is typically damaged. Fourth, (4) the bass drum is typically not mechanically isolated from the drum beater assembly which causes the deterioration of the acoustic output signal. In the absence of adequate mechanical isolation, portions of the acoustic output signal will leak or be transmitted from the bass drum to the supporting structure, e.g., the floor surface, via the drum beater assembly. The loss of a portion of the acoustic output signal in this manner will deteriorate the fidelity of the original generated output signal. Fifth, (5) the distance from the striking point of the drum beater on the drum head-to-the center of the drum head could not be adjusted without changing the "feel of the pedal board" on the drum beater assembly. The lateral adjustment of the drum beater assembly along the horizontal x-axis was very limited. Consequently, the distance from the center of the drum head to the striking point of the drum beater onto the drum head was controlled by adjusting the length of the beater shaft (y-axis). However, adjusting the length of the beater shaft (y-axis) changes the amount of foot pressure that must be applied to operate the pedal board. This changes the "feel of the pedal board" which is sensed by the operator of the bass drum. Unfortunately, these two features were not independently adjustable.

With these inherent problems associated with the bass drum design in mind, reference should be made to U.S. Pat. No. 5,726,370 issued to Yanagisawa on Mar. 10, 1998. Yanagisawa allegedly teaches a hoop clamping system for bass drum assemblies featuring an assembly attached to the foot pedal's floor plate into which the handle bolt is attached and made easily accessible from the side of the pedal. The toe clamp is activated by a pivoting cam, one end of which is under the heel of the toe clamp; the other in contact with the handle bolt. Turning the handle bolt causes the cam to lift or lower the heel of the toe clamp resulting in the desired clamping action. This hoop clamp system provides greater range of travel for the foot board, and substantially improves accessibility to the handle bolt for ease of adjusting the toe clamp. This hoop clamping system further reduces unwanted vibration and lowers manufacturing costs. The Yanagisawa toe clamp 47 is described in column 3 beginning with line 38 and is clearly shown in FIGS. 4 and 6. Further, Yanagisawa FIG. 1 shows a prior art toe clamping mechanism which is briefly discussed at column 1, lines 23-41. It is noted that the prior art hoop clamping structure for a bass drum includes a toe or hoop clamp 71 on a drum pedal device 70. The clamp 71 engages the drum head loop 62 which is provided on the drum body 61 of the bass drum 60. The toe clamp 71 is pivoted by a T-bolt 72 which secures the drum pedal 70 to the bass drum 60. The pedal operated drum beater 73 is supported on a base 74, and the beater 73 is operated by a foot pedal plate 75.

U.S. Pat. No. 5,185,489 issued to Hoshino on Feb. 9, 1993 discloses a drum hoop clamp structure for use on a drum pedal that includes a pivotable clamp body supported on the drum beater as a pivot base for the clamp body and a clamping jaw rotatably journaled to the clamp body at one side of the clamp body pivot. When the clamp body pivots to move the clamp jaw against the drum hoop, the rotatable clamp jaw rotates with respect to the clamp body to an orientation providing fullest contact between the clamping surface of the clamp jaw and the drum hoop, regardless of the shape of the clampable surface of or the thickness of the drum hoop. FIGS. 5, 6 and 7 disclose the prior art and are described in column 1, lines 10-35. FIG. 5 of Hoshino '489 is identical to the FIG. 1 of the Yanagisawa '370 patent and includes a hoop clamping structure for a bass drum having a hoop clamp 71 on a drum pedal device 70. The hoop lamp 71 engages the drum head hoop 62 which is provided on the drum body 61 of the bass drum 60. The hoop clamp 71 is tightened and then fixed by a T-bolt 72, which secures the drum pedal 70 to the bass drum 60. The pedal operated drum beater is supported on a base 74, and the beater is operated by a pedal plate 75. As shown in prior art FIG. 6, clamping is performed with the tip of the drum head hoop engaging part 79 being raised. FIG. 7 shows the clamping of a thinner drum hoop 64 by tightening the T-bolt 72. In both cases, the engaging part 79 is raised making the connection between the bass drum and the drum pedal unstable.

U.S. Patent Publication No. US 2006/0005689 A1 by Ito published Jan. 12, 2006 discloses a pedal coupling device. The pedal coupling device includes a body holding frame for holding the body of a bass drum, a base for placement on a supporting surface and coupled to a pedal device, and a bolt, which is a shaft for coupling the base to the body holding frame to be rotatable relative to each other. The base is rotatable between a coupling position at which the base is coupled to the pedal device and a storing position at which the base is located closer to the body. Rotating the base to the storing position when storing or carrying the bass drum enables compact storage of the pedal coupling device. Thus, the pedal coupling device is suitable for storing and carrying the bass drum.

The Ito pedal coupling device 12 as shown in FIGS. 2-3 is disclosed on page 2, right column in paragraph [0027]. The pedal coupling device 12 is formed of a body holding frame 31, which holds the body 2 of the bass drum 1, a base 32, which is located on the floor surface 1a and is coupled to the pedal device 16, and a shaft, which is a bolt 33 in this embodiment. The bolt 33 couples the base 32 and the body holding frame 31 to be rotatable relative to each other. The body holding frame 31 and the base 32 are made of sheet steel. In paragraph [0040], left column on page 4, Ito '689 notes that according to the pedal coupling device 12 of the preferred embodiment, the inclination angle of the bass drum 1 is easily changed by varying the length of the rear legs 11 to be inserted in the body 2. Furthermore, the beating spot of the beater 27 on the front head 3 and the stroke of the beater 27 are easily adjusted in accordance with the inclination angle of the bass drum 1. In paragraph [0044], left column on page 4, Ito '689 notes that the pedal device 16 is stably mounted to the bass drum 1 as compared to the conventional pedal device, which is mounted to the bass drum 1 by clamping the hoop 5. Additionally, in paragraph [0045], left column on page 4, the joint portion 44 on the forward section of the pedal coupling device 12 becomes thicker toward the clamp 17 and is entirely sandwiched by the clamp 17 as shown in FIG. 2. This prevents the pedal coupling device 12 from being separated from the pedal device 16 during a performance. In paragraph [0031] on page 3, lines 1-6, Ito notes that a front leg 51 located on the lower surface of the bottom surface portion 45 contacts the floor surface 1a to support the front portion of the bass drum 1 with the floor surface 1a. The front leg 51 is formed into a columnar shape with rubber material.

The prior art FIG. 7 appearing in the Ito Patent Publication US 2006/0005689 relates to U.S. Pat. No. 4,829,874 issued to Hoshino on May 16, 1989. Hoshino '874 discloses a bass drum support to position the drum beating spot at a desired height, to prevent stress at the connection of the drum to a foot pedal operated drum beater and to minimize transmission of vibration from the drum body to the support and the foot pedal. A front support leg is supported at the center of the front end of the body of the drum through a vibration absorption set, made, for example, of rubber. A pair of rear support legs extend to the rear part of the drum body and are resilient. The lengths of the rear support legs are adjustable. The rear legs are inclined forwardly of the drum body. Clamping of the front end of the drum by the drum beater pedal assembly is avoided.

FIG. 6 of Hoshino '874 is duplicate to the prior art FIG. 7 of Ito Patent Publication US 2006/0005689 A1 and is described in Hoshino '874, column 3, line 58 to column 4, line 11. Hoshino '874 notes that the side view of the bass drum support according to the present invention is shown in FIG. 6. Comparing it with a convention support of FIG. 7, there is no possibility for the metal drum hoop 15 in FIG. 6 to be deformed, or pressed down or sandwiched by the clamp of the foot pedal as in the conventional device. In addition, there is no change in the tuning of the drum which might result from such deformation. In the present drum support, the rear part 11R of the drum body can be held in a comparatively free state by means of the support legs 41, 42. This avoids application of unreasonable force to the drum body and no difficult strains or forces will develop.

Several other prior art designs for connecting the drum beater assembly to the bass drum are also know. They include coupler devices typically known as risers, cradles and hoop attachment devices. In general, a riser device serves to couple a bass drum to a drum beater assembly by lifting one end of the bass drum while relying on the pair of drum spurs (support legs) to lift the opposite end. The top of the riser supports the bass drum either by attaching to the drum hoop or by forming a seat on which the drum shell rests. The bottom of the riser is a connection surface that substitutes for the drum hoop upon which the pedal clamp can grab. All risers make physical contact with the bass drum either on the drum hoop or on the drum shell. A cradle is a device that connects the drum beater assembly to the bass drum by eliminating the pair of spurs (support legs). In effect, the cradle lifts both ends of the bass drum, not just one end of the bass drum like the riser device. A cradle also includes a connection surface upon which the pedal clamp can attach. When using a cradle, the drum beater assembly does not connect to the drum hoop.

Finally, hoop attachment devices are essentially risers that make physical contact with the drum hoop instead of the drum shell of the bass drum. In effect, a hoop attachment device is actually an extension of the drum hoop and thus fails to solve the significant problems associated with the acoustic output signal and the connection interface with the drum beater assembly. Risers that are classified as hoop attachment devices fail to avoid physical contact between the drum beater assembly and the drum hoop. This drum beater assembly-drum hoop contact dampens the resonance of the drum hoop resulting in deteriorating the acoustic output signal of the bass drum. The dampening of the drum resonance also occurs when the surface area of the drum shell is physically contacted. That is, the overall drum resonance is reduced as the amount of external hardware-to-drum shell contact increases, an inverse relationship. Most drum beater assembly-to-bass drum coupling devices do not provide any appreciable lateral adjustability for the drum beater assembly.

Some of these coupler devices include: (1) a riser device by the manufacturer DrumBum which does not provide a stable connection to the bass drum or drum hoop; (2) a home made riser device which also provides an unstable connection to the bass drum; (3) a riser device by the manufacturer Nodar Rode which requires drilling holes into the drum shell; (4) a riser device by the manufacturer Hoshino/Tama which also requires drilling holes into the drum shell and limits lateral drum beater assembly placement options; (5) various hoop attachment devices by various manufacturers including Gibraltar, Mapex, Ludwig, and various homemade designs, each of which limit lateral drum beater assembly placement options, or requires drilling holes in the drum shell, or requires cutting a notch in the drum hoop; and (6) various cradle devices by various manufacturers including (a) DW Drums, and (b) Danmar Percussion, both of which limit the lateral placement options of the drum beater assembly, and are designed for using a drum beater assembly with a non-bass drum.

Other prior art references show a prior art hoop clamping structure which includes a hoop clamp comprising a set of jaws. The space or gap formed in the jaws of the hoop clamp is controlled by a threaded T-bolt. The hoop clamp or set of jaws is used to grasp the lower circumference of the drum hoop of the bass drum. As with the other conventional connection arrangements between the drum beater assembly and the bass drum, the lateral placement options of the drum beater assembly are extremely restricted. Consequently, the horizontal x-axis coordinate of the striking point of the beater head on the drum head is essentially fixed in position and the range of the pitch and amplitude of the acoustic output signal is limited.

Thus, there is a need in the art for a baseplate for use with a bass drum which (1) provides lateral placement options for the connection of the drum beater assembly-to-the bass drum for conveniently repositioning the striking point of the beater head along the horizontal x-axis of the drum head; (2) enables the beater head and the pedal clamp of the drum beater assembly to be laterally adjusted along the x-axis coordinate while the length of the beater shaft and the distance from the striking point of the beater head-to-the center of the drum head are adjustably independent of one another; (3) protects the drum hoop of the bass drum from damage caused by the pedal clamp of the drum beater assembly; (4) isolates the bass drum from the drum beater assembly resulting in improved resonance performance of the bass drum; and (5) enables adjusting the distance from the striking point of the beater head onto the drum head-to-the center of the drum head without changing the "feel of the pedal board" of the drum beater assembly.

DISCLOSURE OF THE INVENTION

Briefly, and in general terms, the present invention provides a new and improved baseplate for use with a bass drum and, in particular, a baseplate typically used as a mechanical interface in connecting a drum beater assembly-to-the bass drum, where the baseplate provides alternative connection points for the drum beater assembly-to-the baseplate which, in turn, connects to the bass drum. The baseplate facilitates (1) the lateral adjustment of a beater head of the drum beater assembly, (2) for adjusting the impact striking point of the beater head onto a drum head of the bass drum, (3) while the length of a beater shaft of the drum beater assembly and (4) the distance from the striking point of the beater head-to-the center of the drum head are independently adjustable.

In a preferred embodiment, the inventive baseplate is typically fashioned from a suitable metal and includes a center plate having a pair of wing offsets extending therefrom in an upright manner. Extending outwardly from the distal ends of the pair of wing offsets is a pair of wings exhibiting a suitable curvature for cradling a drum shell of the bass drum. Each of the pair of wings includes at least one penetration for adjustably securing each wing to a lug that is threadedly affixed to the drum shell. In this manner, the baseplate is securely affixed to the drum shell of the bass drum. The penetration formed in each of the pair of wings comprises at least one slot or, in the alternative, at least one hole to accommodate fasteners passing through the drum shell into the lug.

A connection plate that is of unitary construction with the center plate extends outward and away from the center plate. The connection plate includes a terminal end having a lip formed thereon which functions as an interface with a pedal clamp of the drum beater assembly. The lip which comprises a fold in the metal material is formed at the distal end or terminal end of the connection plate. The pedal clamp is capable of adjustably attaching to any point along the length of the lip for connecting the drum beater assembly-to-the bass drum. In particular, the pedal clamp of the drum beater assembly is removably connectable via a set of adjustable jaws to any point along the lip of the connection plate for laterally adjusting the striking point of the beater head of the drum beater assembly onto the bass drum. Further, the bass drum is isolated from the pedal clamp for improving the resonance performance of the bass drum without changing the length of a beater shaft of the drum beater assembly, or without changing the feel of the pedal board of the drum beater assembly.

In the preferred embodiment, the isolation of the pedal clamp from the bass drum is accomplished by employing an isolation medium positioned between the drum shell of the bass drum and each of the pair of wings of the inventive baseplate. The isolation medium serves to acoustically isolate each of the pair of wings from the bass drum. The isolation is physically accomplished by utilizing a washer or a grommet or a gasket between each of the pair of wings and the drum shell when the inventive baseplate is installed. In effect, the relative isolation is the result of the baseplate sitting below the isolation mediums comprising the grommets, washers or gaskets. Without these isolation mediums, the relative isolation achieved will not be satisfactory. It is also noted that this relative isolation (compared to similar prior art devices) is the result of the baseplate not requiring any more drum shell-to-hardware physical contact than is already required for conventional bass drum designs. In effect, the inventive baseplate isolates the pedal clamp of the drum beater assembly from the bass drum without the requirement of additional hardware contact against the drum shell which contributes to less distortion of the acoustic output signal.

The material comprising the drum head, for example, mylar, is looser near the center of the drum head than at the edge of the drum head. Thus, striking the drum head near the center thereof provides a lower fundamental pitch, while striking the drum head near the edge thereof provides a higher fundamental pitch. Variations of preference of the desired drum pitch of the acoustic output signal requires that the distance from the striking point of the beater head onto the drum head be adjustable. Once the desired fundamental pitch of the acoustic output signal from the bass drum is identified, the locus of points located on the drum head that will provide that fundamental pitch when struck by the beater head can also be identified. This locus of points on the drum head identifies the distance from the striking point of the beater head-to-the center of the drum head. Consequently, the x-y coordinates of the striking point of the beater head that falls on the locus of points on the drum head must be selected to include the length of the beater shaft (y-axis coordinate) and the lateral adjustment of the drum beater assembly on the baseplate (x-axis coordinate). By utilizing the inventive baseplate for interfacing the drum beater assembly-to-the bass drum, the striking point of the beater head can be adjusted by laterally shifting the drum beater assembly along the lip of the connection plate and then securing the pedal clamp thereto. As a result of utilizing the inventive baseplate, (1) the length of the beater shaft (which affects the feel of the pedal board), and (2) the distance from the striking point of the beater head-to-the center of the drum head (which affects the characteristics of the acoustic output signal) are adjustable independent of one another.

The present invention is generally directed to a baseplate for use with a bass drum including a center plate having a pair of wing offsets and a pair of wings. The pair of wings are connected to and extend outwardly from the wing offsets and each of the wings exhibits a curvature for cradling a drum shell of the bass drum. Further, each wing has at least one penetration formed therein for receiving at least one mechanical fastener extending through the drum shell for adjustably securing each wing to a lug affixed to the drum shell. A connection plate being of unitary construction with and extending from the center plate has a terminal end with a lip formed thereon. The lip of the connection plate adjustably interfaces with a pedal clamp of a drum beater assembly for connecting the drum beater assembly to the bass drum. The drum beater assembly also includes a beater head for striking a drum head of the bass drum for providing an acoustic output signal. The pedal clamp can be removably connected to any point along the lip for laterally adjusting the striking point of the beater head onto the drum head of the bass drum. The striking point of the beater head onto the drum head can be laterally adjusted without changing the length of a beater shaft of the drum beater assembly. This lateral adjustment facilitates the creation of the acoustic output signal of the bass drum having the desired pitch and amplitude while simultaneously maintaining the preferred feel of a pedal board employed for operating the beater head of the drum beater assembly. Further, the baseplate serves to protect a drum hoop of the bass drum from the damage typically caused by the pedal clamp of the drum beater assembly, and to isolate the bass drum from the pedal clamp for improving the resonance performance of the bass drum.

These and other objects and advantages of the present invention will become apparent from the following more detailed description, taken in conjunction with the accompanying drawings which illustrate the invention, by way of example.

DETAILED DESCRIPTION OF THE INVENTION

Figure 1:
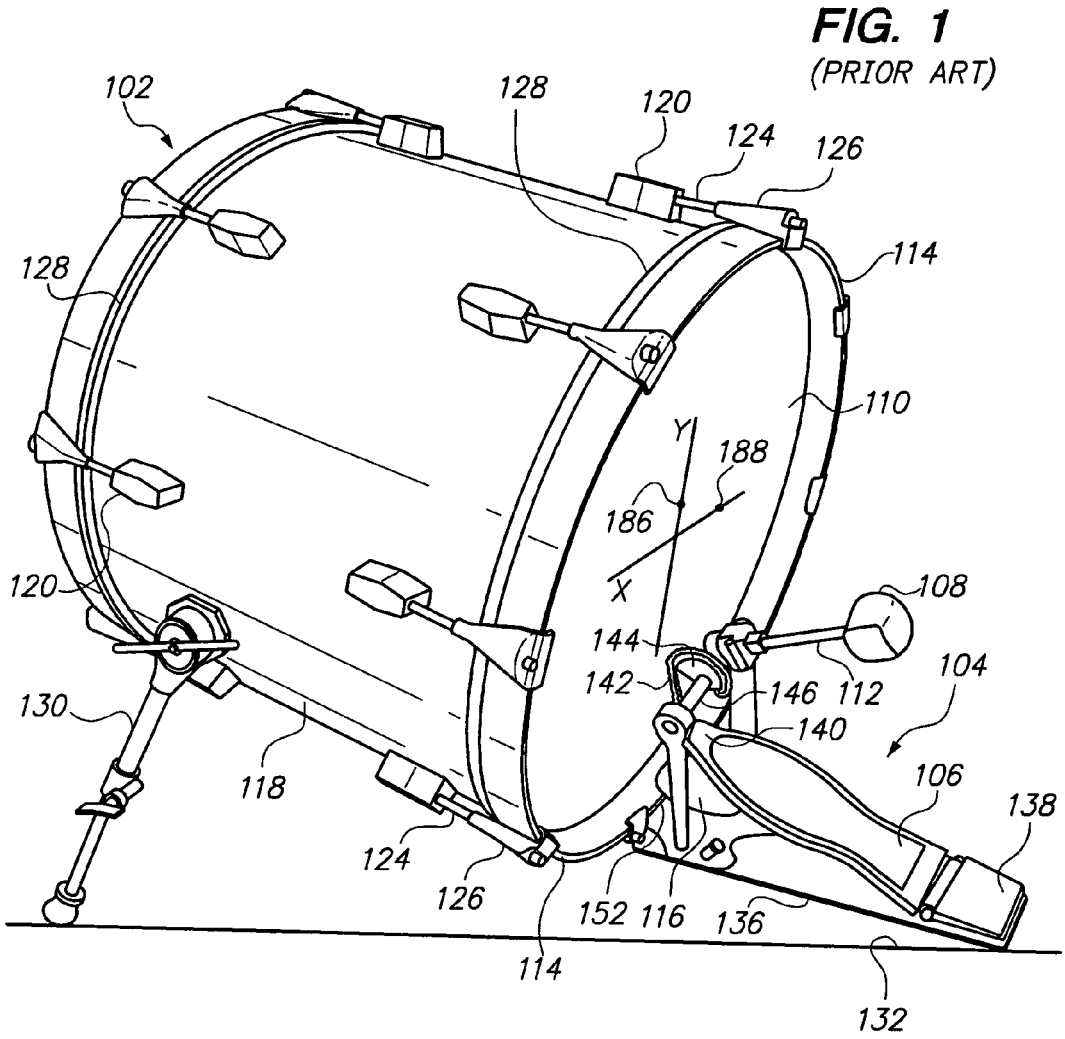
FIG. 1 (PRIOR ART)
FIG. 1 is a perspective view of a bass drum in combination with a drum beater assembly showing the conventional connection arrangement of the drum beater assembly to a hoop of a drum shell of the bass drum of the prior art.

The present invention relates to a baseplate 100 for use with a bass drum 102 as shown in FIGS. 1-12. In particular, the baseplate 100 functions as a mechanical connection interface between a drum beater assembly 104 and the bass drum 102. The baseplate 100 provides alternative connection points for connecting the drum beater assembly 104 to the baseplate 100 where the drum beater assembly 104 includes a pedal board 106 and a beater head 108 as clearly shown in FIG. 2.

The alternative connection points provided by the baseplate 100 for the drum beater assembly 104 facilitates {a} the lateral adjustment of the beater head 108 of the drum beater assembly 104, {b} for adjusting the impact striking point of the beater head 108 onto a drum head 110 of the bass drum 102. This lateral adjustment of the impact striking point of the beater head 108 onto the drum head 110 is accomplished by using the baseplate 100 where {c} the length of a beater shaft 112 of the drum beater assembly 104, and {d} the distance from the striking point of the beater head 108-to-the center of the drum head 110 are independently adjustable. In other words, the impact striking point of the beater head 108 of the drum beater assembly 104 onto the drum head 110 of the bass drum 102 can be laterally adjusted without changing the length of the beater shaft 112 of the drum beater assembly 104 as shown in FIG. 2.

Thus, the inventive baseplate 100 enables: (1) laterally adjusting the distance from the impact striking point of the beater head 108-to-the center of the drum head 110; (2) for achieving the desired pitch and amplitude of the acoustic output signal of the bass drum 102; (3) while simultaneously maintaining the preferred feel of the pedal board 106 by not changing the length of the beater shaft 112 of the drum beater assembly 104; (4) protecting a drum hoop 114 of the bass drum 102 from damage by a pedal clamp 116 of the drum beater assembly 104; (5) the length of the beater shaft 112 and the distance of the striking point of the beater head 108-to-the center of the drum head 110 are independently adjustable, and (6) isolating the bass drum 102 from the pedal clamp 116 of the drum beater assembly 104 for improving the resonance performance of the bass drum 102. This isolation of the pedal clamp 116 from the bass drum 102 is accomplished without any addition surface area physical contact between the drum beater assembly 104 and the bass drum 102.

The bass drum 102 is defined in The American Heritage Dictionary, Second College Edition, Copyright 1982, 1985 by Houghton Mifflin Company of Boston, Mass., page 161 (right column), as a large drum having a cylindrical body and two drum heads and producing a low resonant sound. On page 1052 of the same American Heritage Dictionary, the term "resonance" as it relates to the subject of acoustics is defined as the intensification and prolongation of sound, especially of a musical tone, produced by sympathetic vibration. An example of the conventional bass drum 102 with the conventional drum beater assembly 104 including the pedal board 106 and beater head 108 of the prior art is clearly shown in FIG. 1. Likewise, the conventional drum beater assembly 104 is shown in FIG. 2. FIGS. 1-4 describing the bass drum 102, drum beater assembly 104, and specific examples of the mechanical interface between the bass drum 102 and the drum beater assembly 104 of the prior art will now be discussed.

Figure 2:
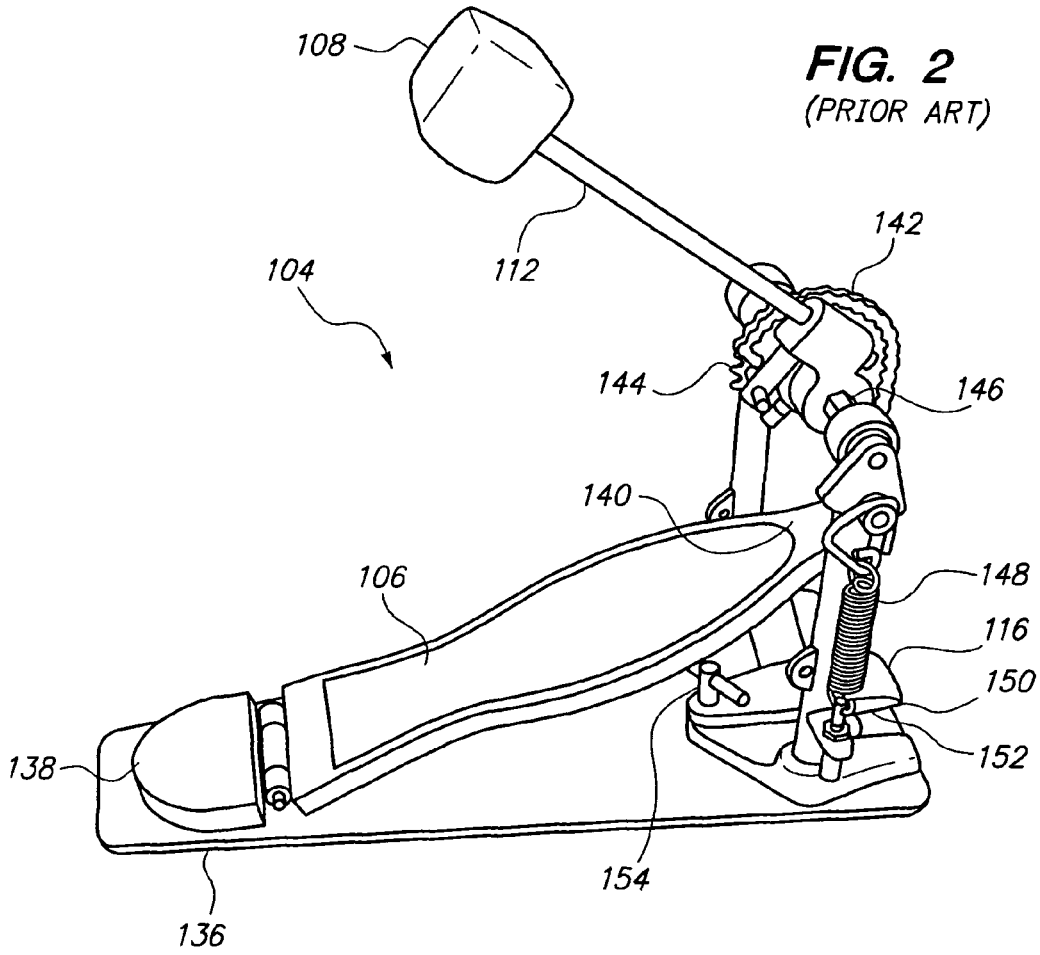
FIG. 2 (PRIOR ART)
FIG. 2 is a perspective view of a conventional drum beater assembly utilized with the bass drum of FIG. 1 showing a pedal board, beater head, beater shaft and a pedal clamp employed to attach the drum beater assembly to the hoop of the drum shell in the prior art.

The bass drum 102 in combination with the drum beater assembly 104 are shown in FIGS. 1 and 2. The base drum 102 includes as previously noted the drum head 110 and the drum hoop 114 while the drum beater assembly 104 includes the pedal board 106, beater head 108, beater shaft 112, and the pedal clamp 116. The bass drum 102 further includes a cylindrical drum shell 118 typically comprised of wood such as, for example, a plywood cylinder which vibrates as a result of being struck by the beater head 108 of the drum beater assembly 104. Threadedly mounted in a symmetrical manner around each end of the cylindrical drum shell 118 is a plurality of lugs 120. The lugs 120 appear as rectangular-shaped metal boxes that are removably attached to the drum shell 118 with threaded fasteners 122 as shown in FIG. 8. The function of the lugs 120 is to receive and anchor a corresponding plurality of threaded tension rods 124. The tension rods 124 are connected to a correspondingly number Of clamping devices or claws 126 attached to the drum shell 118. The claws 126 are employed to secure the drum hoop 114 in position for tensioning the drum head 110. The clamping devices or claws 126 are shown clamped over the edge of the drum hoop 114 in FIGS. 1, 6 and 7.

Figure 6:
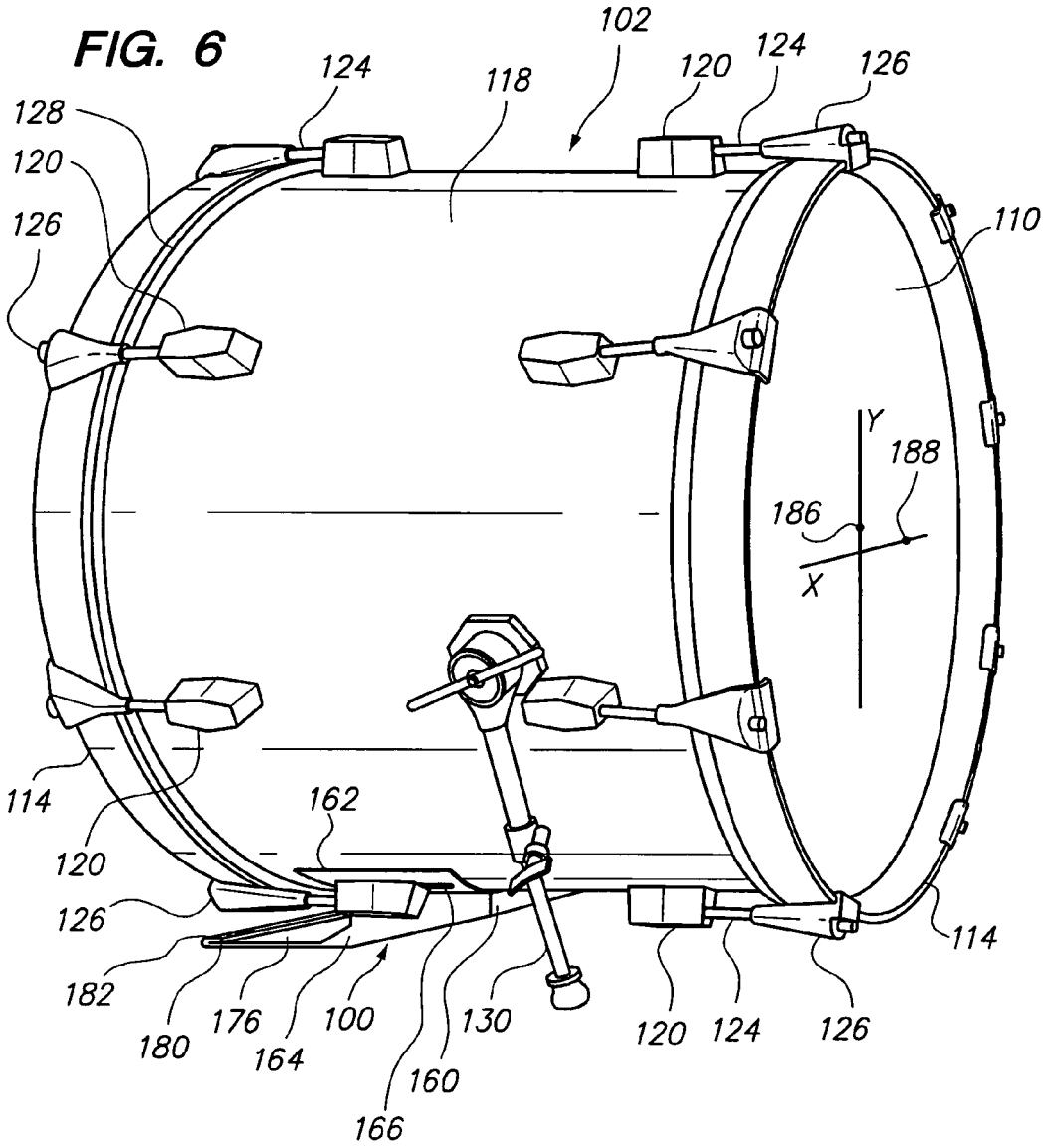
FIG. 6 is a perspective view of the baseplate of FIG. 5 of the present invention shown affixed to the drum shell of the bass drum at a plurality of lugs, the inventive baseplate positioned to cooperate with the pedal clamp of the drum beater assembly.
Figure 7:
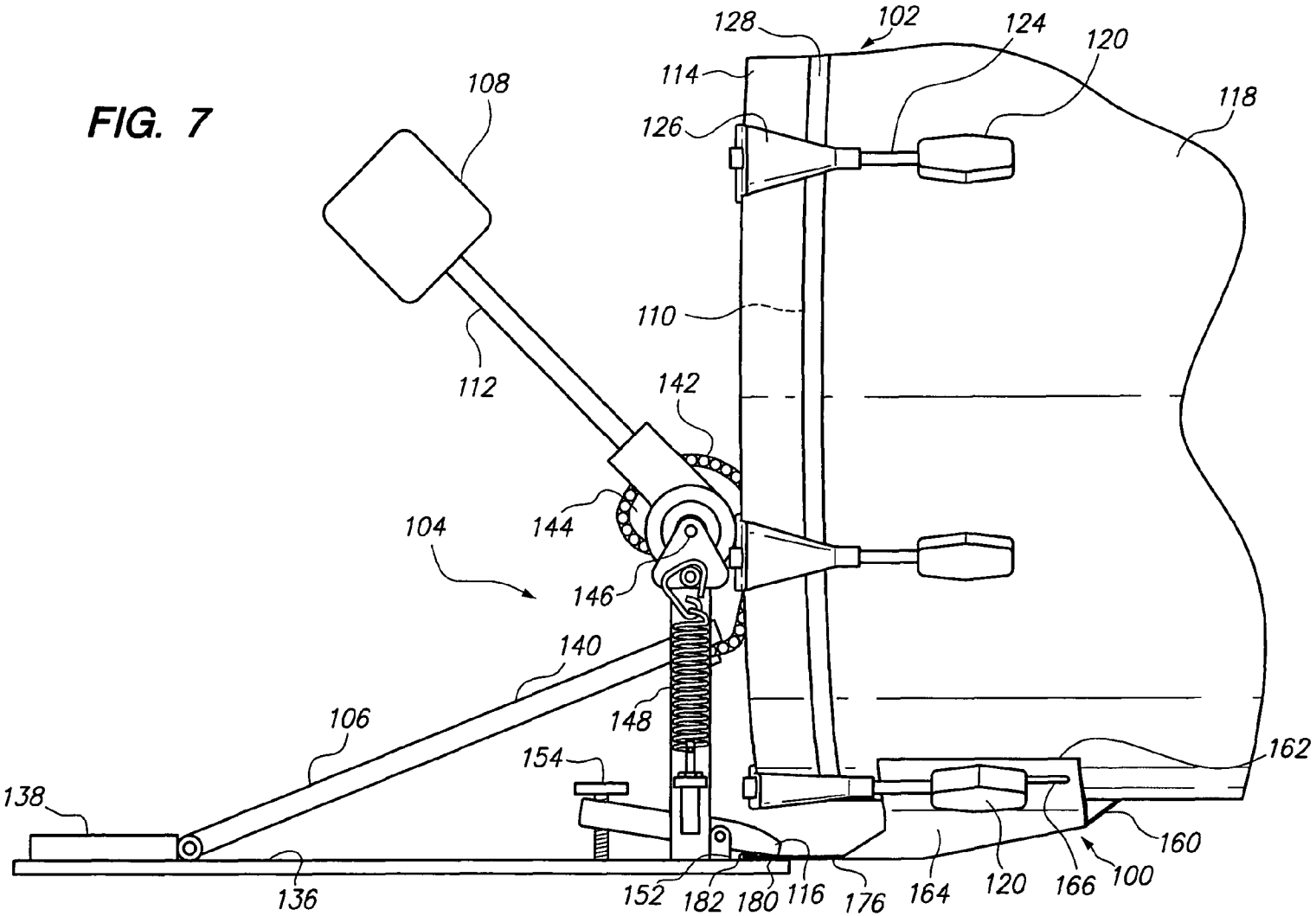
FIG. 7 is a side elevation view of the baseplate of FIG. 6 of the present invention shown affixed to the drum shell of the bass drum at the plurality of lugs, the baseplate shown positioned between the bass drum and the drum beater assembly, the pedal clamp of the drum beater assembly being laterally adjustable along the lip of the baseplate.
Figure 8:
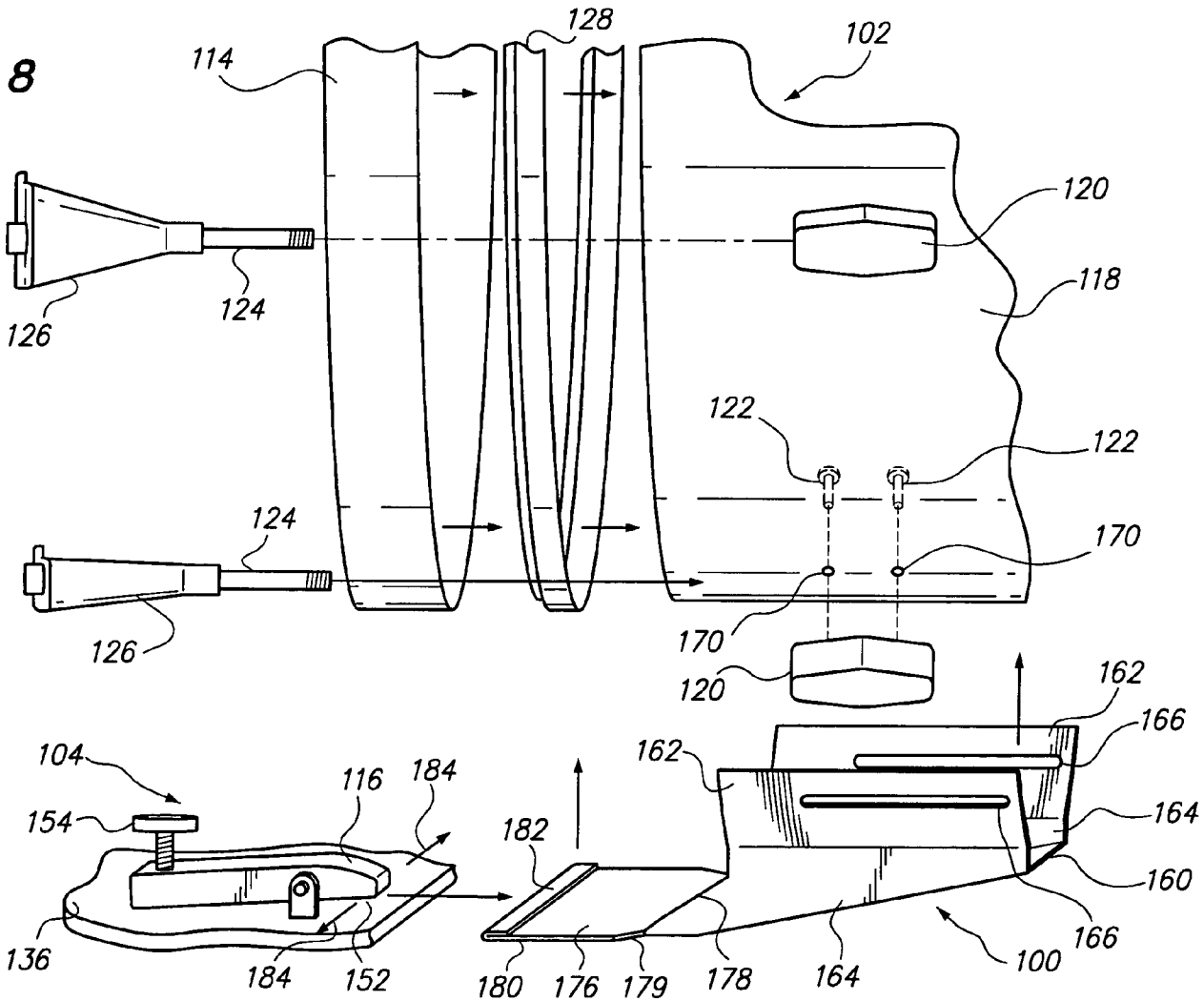
FIG. 8 is an exploded view of the assembly shown in FIG. 7 of the present invention showing the lip of the baseplate separated from the pedal clamp of the drum beater assembly, and a wing of the baseplate separated from the lug of the drum shell of the bass drum.

The drum head 110 shown best in FIGS. 1 and 6 is the surface area of the bass drum 102 that is struck by the beater head 108 best shown in FIGS. 1 and 7. The drum head 110 which can be comprised of, for example, a layer of mylar is stretched over the end of the drum shell 118 at a bearing edge 128 shown in FIGS. 1, 6, 7 but shown best in FIG. 8. The drum hoop 114 can be comprised of a metal or wooden cylinder that is employed for holding the drum head 110 onto the drum shell 118. The drum head 110 once installed is trapped between the bearing edge 128 and the drum hoop 114 so that when struck by the beater head 108, the drum head 110 produces the acoustic output signal in the form of a percussion sound. In the conventional connection arrangement between the drum beater assembly 104 and the bass drum 102, the drum hoop 114 typically served as an attachment point for the pedal clamp 116 of the drum beater assembly 104 as shown in FIGS. 1 and 2. The bass drum also includes a pair of support legs or spurs 130 with a first spur located on the left side and a second spur located on the right side of the drum shell 118 as best shown in FIGS. 1 and 6. Each of the spurs 130 is a support device adjustably attached to the drum shell 118 for stabilizing the bass drum 102 when in use. When the pair of spurs 130 is utilized in combination with the inventive baseplate 100, a three-point stabilizing support is created on a floor surface 132 as shown in FIG. 1.

The typical drum set also includes the drum beater assembly 104 which cooperates with the bass drum 102 for producing the acoustic output signal which is a percussion sound. The drum beater assembly 104 is shown in FIG. 1 but is best shown in FIG. 2. In general, the drum beater assembly 104 includes a mounting platform 136 having a rear end 138 of the pedal board 106 hinged thereto. A forward end 140 of the pedal board 106 is attached to a chain 142 that is affixed to and meshes with a toothed gear 144 mounted on a rotating arm 146. The chain 142 and rotating arm 146 are caused to rotate by applying a downward force to the pedal board 106. The required downward force to be applied to the pedal board 106 is determined by an adjustable spring 148 suspended between the rotating arm 146 and the mounting platform 136. Mounted to the rotating arm 146 is the beater shaft 112 with the beater head 108 affixed to the distal end of the beater shaft 112. Upon applying the appropriate downward force to the pedal board 106, the chain 142 is drawn downward and the toothed gear 144 is caused to rotate while the beater shaft 112 and beater head 108 are thrust forward.

In the conventional prior art bass drum 102, the drum beater assembly 104 is directly physically connected to the bass drum 102 in the following manner. Positioned on the mounting platform 136 of the drum beater assembly 104 is the pedal clamp 116 which is used to capture the drum hoop 114 of the bass drum 102. A gap 150 exists between the pedal clamp 116 and the mounting platform 136 which forms a jaw 152. The size of the jaw 152 is determined by an adjustment knob 154 positioned on the mounting platform 136. By positioning the jaw 152 comprising the pedal clamp 116 over the drum hoop 114 and tightening the adjustment knob 154, the drum beater assembly 104 is directly physically connected to the bass drum 102. When the adjustment knob 154 is loosened, the jaw 152 can be moved away from the drum hoop 114 terminating the physical connection. Because of this direct connection, it is noted that a portion of the acoustic output signal generated by striking the drum head 110 of the bass drum 102 is shunted away to the floor surface 132 via the drum beater assembly 104. This action results in some distortion of the generated acoustic output signal.

Figure 3:
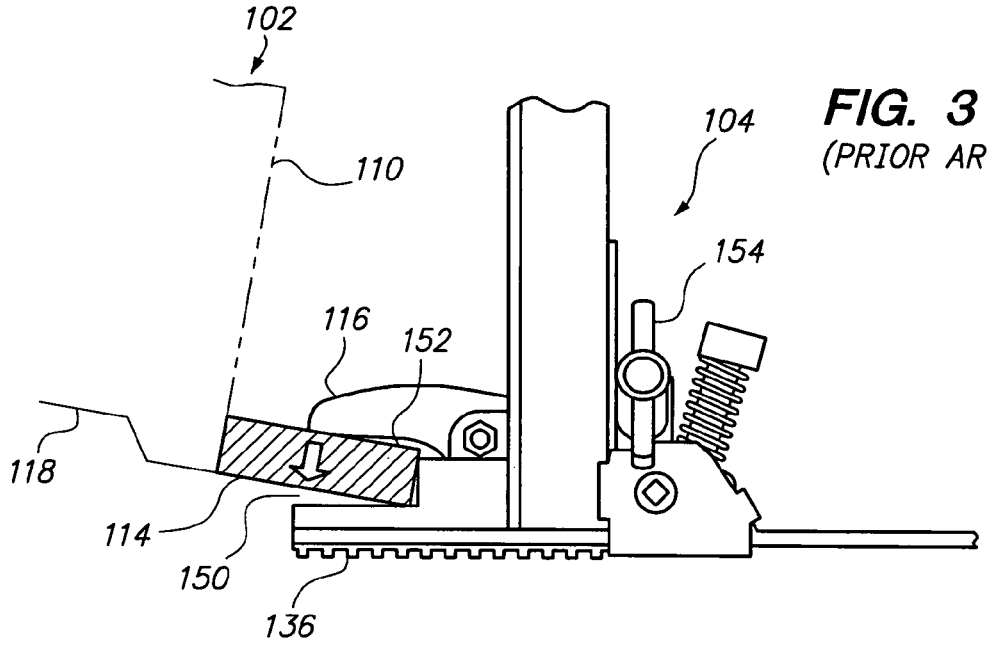
FIG. 3 (PRIOR ART)
FIG. 3 is a first side elevation view partially in section showing a pedal clamp of a first conventional drum beater assembly of the prior art having a set of adjustable jaws for capturing the hoop of the drum shell by tightening a T-bolt.

An example of a prior art connection arrangement between the drum beater assembly 104 and the bass drum 102 is disclosed in FIG. 3 herein. In this arrangement, the drum beater assembly 104 includes the mounting platform 136 which supports the pedal clamp 116. The separation or gap 150 exists between the pedal clamp 116 and the mounting platform 136 for forming the jaw 152. The size of the gap 150 can be modified for opening and closing the jaw 152 by operating the adjustment knob 154. Once the adjustment knob 154 has been manipulated to open the jaw 152, the drum beater assembly 104 can be positioned to capture the drum hoop 114 of the bass drum 102 as shown in FIG. 3 herein. Thereafter, the adjustment knob 154 can be manipulated once again to cause the jaw 152 comprised of the pedal clamp 116 and the mounting platform 136 to pinch downward on the drum hoop 114 as shown by the downward arrow. This action will physically secure the drum beater assembly 104 to the bass drum 102 for enabling the actuation of the beater head 108 via the pedal board 106 for striking the drum head 110 stretched over the end of the cylindrical drum shell 118. The drum hoop 114 can be released from the jaw 152 of the drum beater assembly 104 by loosening the adjustment knob 154.

Figure 4:
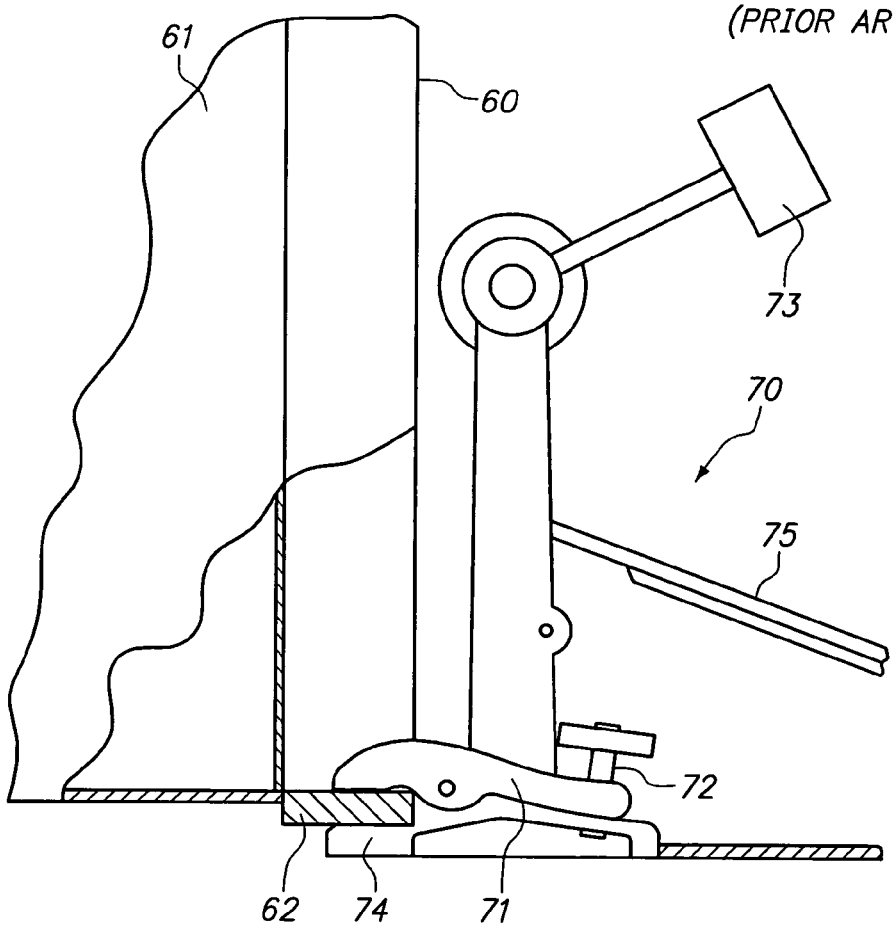
FIG. 4 (PRIOR ART)
FIG. 4 is a second side elevation view partially in section showing a pedal clamp of a second conventional drum beater assembly of the prior art having a set of adjustable jaws securely attached to the hoop of the drum shell by tightening a T-bolt.

A similar prior art hoop clamping structure for a bass drum is disclosed in both U.S. Pat. No. 5,726,370 to Yanagisawa and U.S. Pat. No. 5,185,489 to Hoshino. The prior art toe clamping mechanism is briefly discussed at column 1, lines 23-41 of the Yanagisawa '370 patent and at column 1, lines 11-19 of the Hoshino '489 patent, and is presented as FIG. 4 herein. Referring to FIG. 4, it is noted that the prior art hoop clamping structure for a bass drum 60 includes a toe or hoop clamp 71 on a drum pedal device 70. The toe or hoop clamp 71 engages the drum head loop 62 which is provided on the drum body 61 of the bass drum 60. The toe clamp 71 is pivoted by a T-bolt 72 which secures the drum pedal 70 to the bass drum 60. The pedal operated drum beater 73 is supported on a base 74, and the drum beater 73 is operated by a foot pedal plate 75 as shown in FIG. 4 herein.

When the beater head 108 is operated and made to strike the drum head 110 of the bass drum 102, the acoustic output signal or percussion sound is generated. The location at which the beater head 108 impacts the drum head 110 of the bass drum 102 is referred to as the "striking point". The drum head 110 is generally circular in nature and can be viewed as a unit circle having a horizontal x-axis and a vertical y-axis which creates the four quadrants of a Cartesian coordinate system. The two coordinates of the Cartesian system are shown illustrated on the drum head 110 in FIGS. 1 and 6. (In FIG. 6, the x-y coordinate system is illustrated on the front drum head 110 since the rear drum head 110 is not visible.) Each of the four quadrants is separated by ninety degrees from each adjacent quadrant which meet at the center of the drum head 110 as shown in FIGS. 1 and 6. That is, the intersection of the horizontal x-axis and the vertical y-axis is the center of the drum head 110 (sometimes referred to as the drum head center). The determination as to which of the four quadrants on the drum head 110 that the beater head 108 strikes is a function of the x-y coordinates of the striking point. Consequently, if the location of the striking point on the drum head 110 changes, then the x-y coordinates of the striking point are also changed. In effect, the x-y coordinates on the drum head 110 at the point of impact by the beater head 108 can be viewed as the Cartesian address of the "striking point".

It should be understood that the striking point of the beater head 108 onto the drum head 110 can be changed by either changing the horizontal x-axis coordinate and/or the vertical y-axis coordinate. The horizontal x-axis coordinate can be changed by laterally adjusting the drum beater assembly 104 with respect to the baseplate 100. Likewise, the vertical y-axis coordinate can be changed by altering the length of the beater shaft 112. It is noted that (1) the position of the drum beater assembly 104 with respect to the baseplate 100 determines the x-axis distance between the striking point of the drum beater 108 and the center of the drum head 110, while (2) the length of the beater shaft 112 determines the y-axis distance between the striking point of the beater head 108 and the center of the drum head 110. Thus, both the length of the beater shaft 112 and the lateral placement of the drum beater assembly 104 on the baseplate 100 are factors in determining the resultant distance between the striking point and the center of the drum head 110.

Further, when the striking point is moved from a first x-y coordinate to a second x-y coordinate on the drum head 110, the characteristics of the acoustic output signal change which affects the percussion sound generated by the bass drum 102. The new striking point is now located within a locus of points on the drum head 110 typically included in a concentric circle surrounding the center of the drum head 110. All "striking points" of the beater head 108 that impact the drum head 110 within this locus of points falling on the concentric circle surrounding the center of the drum head 110 will provide an acoustic output signal having the same characteristics. Thus, the beater head 108 can strike the drum head 110 at a plurality of points surrounding the center of the drum head 110 and still produce an acoustic output signal have the same percussion sound.

In the conventional connection arrangement between the bass drum 102 and the drum beater assembly 104, the pedal clamp 116 is rigidly attached to the bottom or lowest point of the curved drum hoop 114. Thus, the horizontal x-coordinate of the striking point in the conventional connection arrangement is essentially fixed. Any lateral adjustment of the pedal clamp 116 along the curved drum hoop 114 is extremely limited. However, the vertical y-coordinate of the striking point can be adjusted by altering the length of the beater shaft 112. Thus, the range of striking points is essentially limited to (1) the locus of points along the y-axis coordinate which is determined by the length of the beater shaft 112, and (2) the essentially fixed x-axis coordinate which is determined by the lowest point on the circumference of the drum hoop 114 to which the pedal clamp 116 is rigidly attached. Consequently, in the conventional connection arrangement, (a) the length of the beater shaft 112, and (b) the distance from the striking point of the beater head 108-to-the center of the drum head 110 were not independently adjustable from one other. Further, the x-y coordinates of the striking point of the beater head 108 onto the drum head 110 of the bass drum 102 determines the pitch and amplitude of the acoustic output signal or percussion sound.

Figure 5:
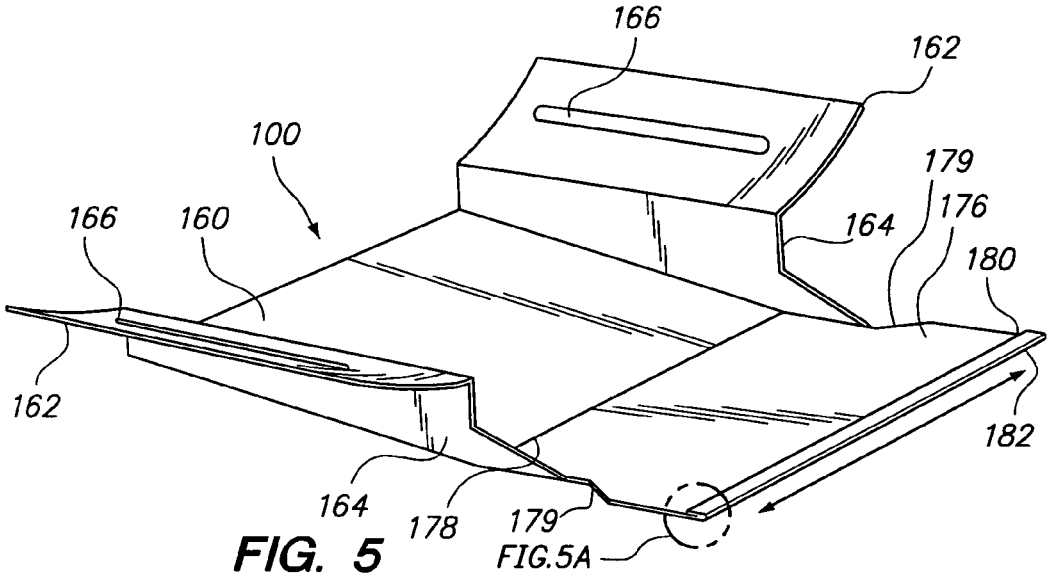
FIG. 5 is a perspective view of the baseplate of the present invention showing a center plate flanked by a pair of wings each including a mounting slot for connecting to a pair of lugs on the drum shell, and a connection plate for providing an extended horizontal connection surface to a pedal clamp of the drum beater assembly of FIG. 2.
Figure 9:
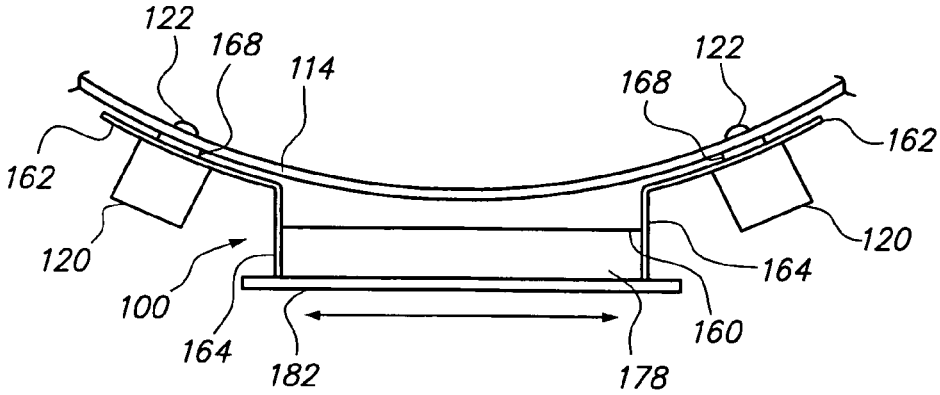
FIG. 9 is a partial end view of the baseplate of FIG. 6 of the present invention showing the pair of wings of the baseplate positioned above the lugs and cooperating with the curved surface of the drum shell, with the wings of the baseplate floating below the drum shell.

The physical structure of the inventive baseplate 100 which functions as a mechanical interface between the bass drum 102 and the drum beater assembly 104 will now be described. The baseplate 100 as shown in FIG. 5 is typically fashioned from any suitable metal and discloses a center plate 160 which functions as the main body of the baseplate 100 to which all other components are attached. Positioned above and extending outwardly from the center plate 160 is a pair of wings 162 which serve to support or cradle the weight of the cylindrical drum shell 118. The pair of wings 162 are physically connected to and positioned above the center plate 160 by utilizing a corresponding pair of wing offsets 164 as shown in FIGS. 5 and 9. The pair of wing offsets 164 are typically of unitary construction with and extend vertically above the center plate 160. In effect, the pair of wing offsets 164 enables each of the wings 162 to be positioned above or offset from the center plate 160 so that the center plate 160 does not come into contact with the drum shell 118 after the baseplate 100 has been positioned between the bass drum 102 and the drum beater assembly 104. This separation between the center plate 160 and the drum shell 118 minimizes any interference with the resonance of the bass drum 102.

Each of the pair of wings 162 exhibits a suitable curvature for cradling and supporting the drum shell 118 of the bass drum 102 as shown in FIGS. 5, 6 and 7. Further, the pair of wings 162 extends outwardly from the center plate 160 at an angle dependent upon the diameter of the cylindrical drum shell 118 and the number of lugs 120 employed in the construction of the drum shell 118. For example, for a bass drum 102 having a drum shell 118 with a diameter of 20" and comprising eight lugs 120, the determination would be as follows. The cylindrical drum shell 118 represents a circle having 180 degrees therein. The cylindrical drum shell 118 includes eight lugs 120 attached thereto as shown in FIGS. 1 and 6. A cylindrical figure having eight vertices is an approximation of an octagon so that each vertex represents approximately 45 degrees (360 degrees divided by eight vertices). In the octagon shape of the cylindrical drum shell 118, each of the eight lugs 120 is located at the center of its respective 45 degree angle. Further, each wing 162 is located directly underneath the corresponding lug 120 as shown in FIGS. 6, 7, and 8 with each wing 162 extending outward away from the vertex of the lug 120 at half the 45 degree angle (i.e., at half the alternate interior angle). Consequently, each of the wings 162 is designed to extend outwardly from the center plate 160 at approximately 22.5 degrees. This angle enables each of the wings 162 to conveniently interface with the lugs 120 mounted on the drum shell 118 as is clearly shown in FIG. 7 herein. A bass drum 102 construction having a different diameter and a different number of lugs 120 would have wings 162 extending outward from the center plate 160 at a different angle.

The function of each of the pair of wings 162 is to cradle and support the weight of the cylindrical drum shell 118 of the bass drum 102. Thus, each wing 162 also includes at least one penetration for adjustably securing the wing 162 to a corresponding lug 120 affixed to the outer surface of the drum shell 118. The penetration formed in each wing 162 is determined by the design of the cylindrical drum shell 118 provided by a particular drum manufacturer. Reference to Applicant's FIGS. 5, 6, 7, 8 and 10 each adopt a mounting slot 166 as the penetration formed in each wing 162. The mounting slot 166 formed in each wing 162 enables the threaded fasteners 122 shown in FIGS. 8 and 9 to pass through the structure of the wing 162 and into the corresponding lug 120. Thus, each wing 162 is removably secured in position between the cylindrical drum shell 118 and the corresponding lug 120 as is clearly shown in FIGS. 6 and 7. It is noted that the slots 166 are preferred to serve as the penetrations in the wings 162 because the inventive baseplate 100 is designed to be utilized with many name brands of base drums 102 which vary in the placement of their lugs 120.

Also positioned between each wing 162 and the drum shell 118 is an isolation medium 168 which typically assumes the form of a grommet, washer or gasket shown best in the end view of FIG. 9. The purpose of the isolation medium 168 is to achieve the optimum level of acoustic isolation between the bass drum 102 and the drum beater assembly 104 to minimize the leakage of the acoustic output signal to the floor surface 132. The isolation medium 168 serves to acoustically isolate each of the wings 162 from the drum shell 118 as shown in FIG. 9 by physically placing a washer, grommet or gasket between each of the wings 162 and the drum shell 118. The isolation is the result of the wings 162 being positioned below the isolation medium 168. Thus, the bass drum 102 is acoustically isolated from the pedal clamp 116 of the drum beater assembly 104 for improving the resonance performance of the bass drum 102. In effect, the isolation medium 168 serves to minimizes the amount of distortion and to maintain the fidelity of the acoustic output signal. In the absence of the isolation medium 168, the relative isolation will not be satisfactory, that is, the level of signal distortion will be unacceptable.

It is also noted that the relative isolation provided is also because the inventive baseplate 100, when installed, does not require any additional surface area contact with the bass drum 102 as compared to conventional bass drum 102 designs. This is the case because (1) the wings 162 are affixed to the lugs 120 which are already mounted on the drum shell 118, and (2) the drum shell 118 is supported by the wings 162 and elevated above the center plate 160, so that there is no additional surface area contact between the baseplate 100 and the drum shell 118 as shown in FIG. 9. Consequently, use of the inventive baseplate 100 does not contribute to deteriorating the resonance performance of the bass drum 102. In effect, the baseplate 100 isolates the pedal clamp 116 from the bass drum 102 without requiring additional hardware contact with the drum shell 118 which contributes to less distortion of the acoustic output signal.

Figure 10:
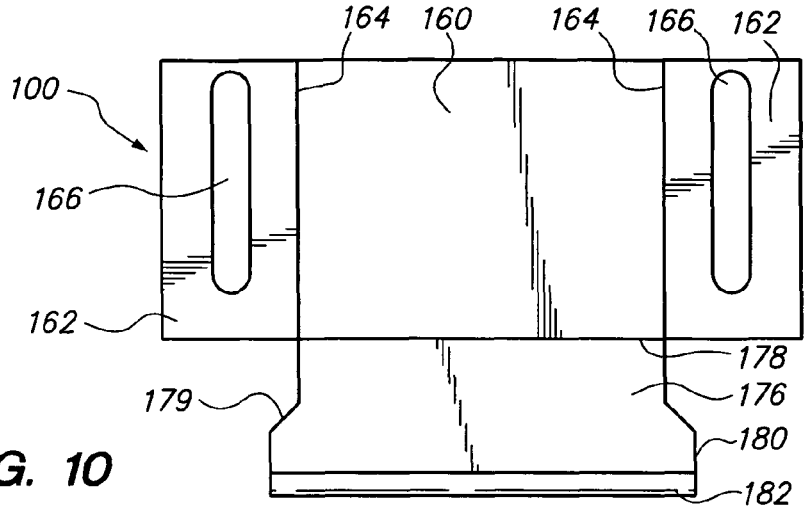
FIG. 10 is a top plan view of the baseplate of FIG. 5 of the present invention showing a pair of slots, with one slot formed within each wing.

The mounting slot 166 formed in each wing 162 clearly shown in FIGS. 5, 6, 7, 8 and 10 is a single closed slot design that requires the disassembly of the corresponding lug 120 from the cylindrical drum shell 118 to accomplish the attachment of the baseplate 100. That is, in order to install the baseplate 100, the interior of the drum shell 118 must be accessed and the threaded fasteners 122 that anchor a particular lug 120 must be removed as illustrated in the exploded view of FIG. 8. Thereafter, the drum shell 118 is lowered onto the pair of wings 162. A pair of fastener holes 170 that accommodate the threaded fasteners 122 are aligned with the corresponding mounting slot 166 of each wing 162 as shown in FIG. 8. The threaded fasteners 122 are passed through the fastener holes 170, the isolation medium 168 comprising the grommet, washer or gasket, and then through the mounting slot 166 formed through each wing 162. The threaded fasteners 122 are ultimately threadedly mounted within the corresponding lug 120 as is clearly shown in FIGS. 7 and 8. The baseplate 100 exhibiting the single closed slot design is shown in plan view in FIG. 10. The use of single closed slots shown in FIG. 10 are intended to provide adjustability to the baseplate 100 for (1) accommodating different arrangements of the lugs 120 provided by different manufacturers of bass drums 102, and (2) controlling the range of extension of the baseplate 100 that interfaces with the drum beater assembly 104 which indirectly controls the lateral placement options available to the drum beater assembly 104. Once installed on the drum shell 118, the baseplate 100 is usually not removed. In other words, the baseplate 100 is left intact on the drum shell 118 during transport of the bass drum 102 while the drum beater assembly 104 is removed during transport.

Figure 11:
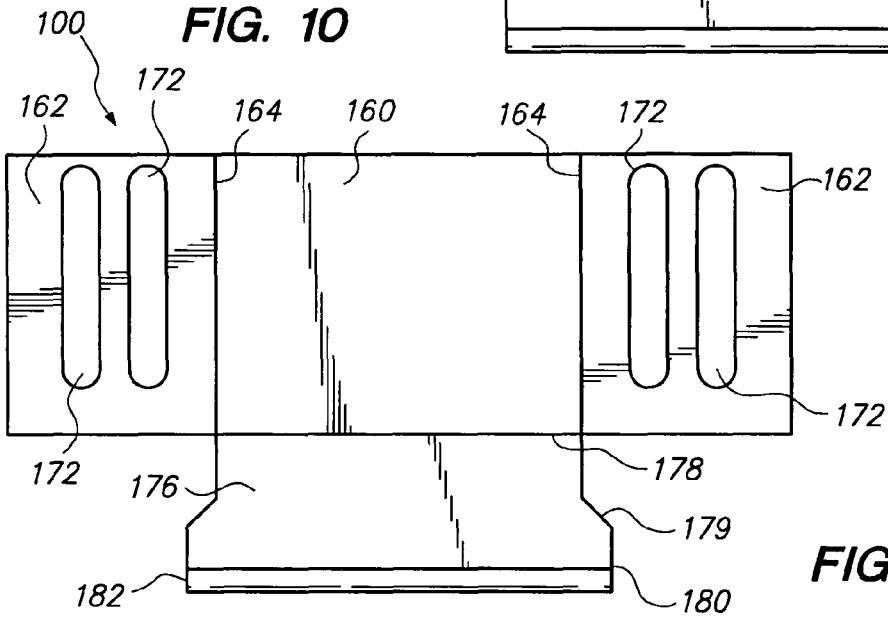
FIG. 11 is a top plan view of the baseplate of FIG. 5 of the present invention showing a plurality of four slots, with two slots formed within each wing.

Different drum manufacturers offer different designs for bass drums 102 having cylindrical drum shells 118 of varying diameters. Many of these designs of bass drums 102 are fitted with a different number of lugs 120 which are distributed over the drum shell 118 in different arrangements. Consequently, the baseplate 100 exhibiting the single closed slot design does not accommodate all base drums 102. As an alternative to the single closed slot design shown in FIG. 10, a double closed slot design having slots 172 is shown in FIG. 11. In the double closed slot design, there are four slots 172 which are arranged to be congruent with the alternative arrangement of lugs 120 provided by some manufacturers of bass drums 102. It is emphasized that the double closed slots shown in FIG. 11 are intended to provide adjustability to the baseplate 100 for (1) accommodating alternate arrangements of lugs 120 provided by manufacturers of bass drums 102, and (2) controlling the range of extension of the baseplate 100 that interfaces with the drum beater assembly 104.

It is clear that the single closed slot design of the inventive baseplate 100 shown in FIG. 10 is very similar to the double closed slot design of the baseplate 100 shown in FIG. 11. In fact, the designs are essentially duplicate except for the number and arrangements of the penetrations, i.e., the single closed slots 166 shown in FIG. 10 and the double closed slots 172 shown in FIG. 11. In each case, the number of slots 166, 172 is directly related to the arrangement of lugs 120 mounted on the cylindrical drum shell 118. Also, it is importance to note that the baseplate 100 shown in both FIGS. 10 and 11 utilize closed slot designs specifically to provide the advantage of adjustability. During installation between the drum shell 118 and lug 120, the baseplate 100 can be manually manipulated to determine how far the baseplate 100 will extend outward towards the drum beater assembly 104.

Figure 12:
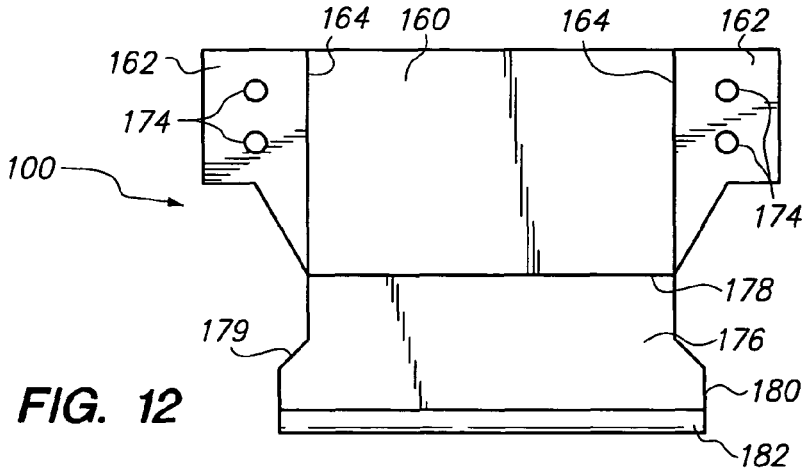
FIG. 12 is a top plan view of the baseplate of FIG. 5 of the present invention showing a plurality of four circular holes, with two circular holes formed within each wing.

However, it is noted that another foreseeable design of the baseplate 100 is shown in FIG. 12. The design shown in FIG. 12 exhibits a plurality of multiple drilled holes 174 in each wing 162 in lieu of the single closed slot design 166 shown in FIG. 10 or the double closed slot design 172 shown in FIG. 11. It is noted that the design of the baseplate 100 shown in FIG. 12 is also essentially identical to those shown in FIGS. 10 and 11 except that the drilled holes 174 replace the single closed slots 166 and the double closed slots 172. Furthermore, the baseplate 100 shown in FIG. 12 is not intended to provide adjustability. In the alternative, the design exhibiting the multiple drilled holes 174 shown in FIG. 12 is intended to illustrate a baseplate 100 that is (1) congruent with a drum shell 118 having a customized arrangement of lugs 120, and (2) a fixed range of extension of the baseplate 100 that interfaces with the drum beater assembly 104.

Figure 5A:
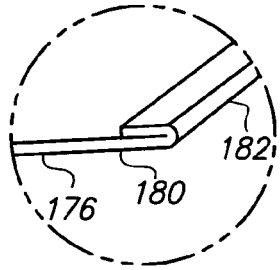
FIG. 5A is a detail drawing of a lip formed on the terminal end of the connection plate of the baseplate of FIG. 5 showing a folded-over section for interfacing with the pedal clamp of the drum beater assembly of FIG. 2.

Extending from the center plate 160 is a connection plate 176 as is clearly shown in FIGS. 5, 8 and 10. In general, the connection plate 176 is fashioned from the same metallic material as the center plate 160 and the pair of wing offsets 164. In other words, the connection plate 176 is in unitary construction with the center plate 160 and the wing offsets 164. Furthermore, positioned between the center plate 160 and the connection plate 176 is a vertical support 178 as shown in FIGS. 5 and 9. The function of the vertical support 178 is (1) to enable the connection plate 176 to be displaced from the center plate 160, and (2) to facilitate the alignment and a smooth interface between the connection plate 176 and the drum beater assembly 104 as shown in FIG. 7. The connection plate 176 expands outward at a point 179 to a width greater than the width of the center plate 160 as shown in FIG. 5. The connection plate 176 also includes a distal end or terminal end 180 having a lip 182 formed thereon. The lip 182 is shaped from approximately a ¼" fold in the metal that forms the terminal end 180 of the connection plate 176 as shown in FIGS. 5 and 5A herein. The long dimension of the lip 182 is essentially the same dimension as the width of the connection plate 176 at the expansion point 179. The lip 182 is used, in general, in the connection between the baseplate 100 and the drum beater assembly 104 to prevent slippage.

The baseplate 100 provides the mechanical interface between the drum beater assembly 104 and the cylindrical drum shell 118 of the bass drum 102 as shown in FIG. 7. In particular, the combination of the connection plate 176 and the lip 182 formed thereon create a removable mechanical bond with the pedal clamp 116 of the drum beater assembly 104. During the connection procedure, the jaw 152 of the pedal clamp 116 of the drum beater assembly 104 is positioned to capture the lip 182 formed on the terminal end 180 of the connection plate 176 as shown in FIGS. 7 and 8. The adjustment knob 154 is used to tighten the pedal clamp 116 down upon the ¼" fold forming the lip 182 to ensure a tight fit and to prevent slippage of the pedal clamp 116 off of the connection plate 176. Use of the adjustment knob 154 enables the loosening and tightening of the jaw 152 to control the lateral movement of the drum beater assembly 104 along the length of the lip 182 of the baseplate 100. In effect, the lip 182 formed on the terminal end 180 of the connection plate 176 completely replaces the drum hoop 114 as the attachment point of the drum beater assembly 104 typically utilized in the prior art.

Further, it is noted that the inventive baseplate 100 does not include a cushioned foot comprised of a rubberized material to support the weight of the bass drum 102 as disclosed in the prior art. The forward weight of the bass drum 102 is supported by the inventive baseplate 100, in particular, (1) the rigidity and strength of the wings 162, and (2) the robust interface connection between the lip 182 of the connection plate 176 and the pedal clamp 116 of the drum beater assembly 104. Furthermore, this support structure in combination with the pair of spurs 130 (support legs) shown in FIG. 1 supports the total weight of the bass drum 102. This is the case even though the inventive baseplate 100 only makes physical contact with the pedal clamp 116 of the drum beater assembly 104, and not the floor surface 132. Although FIG. 7 is only a partial side elevation view, it can be seen that the entire weight of the bass drum 102 is supported by (1) the wings 162 in combination with the interface between the lip 182 and the pedal clamp 116, and (2) the pair of spurs 130 (as shown in FIG. 1). The inventive baseplate 100 does not contact the floor surface 132.

In the present invention, the lip 182 adjustably interfaces with the pedal clamp 116 of the drum beater assembly 104 for connecting the drum beater assembly 104 to the bass drum 102. As indicated by the arrows 184 adjacent to the drum beater assembly 104 shown in FIG. 8, the pedal clamp 116 captures the lip 182 and the pedal clamp 116 is removably connectable to any point along the length of the lip 182 by utilizing the jaw 152. This removable connectivity of the pedal clamp 116 along the length of the lip 182 provides for the lateral adjustment of the striking point of the beater head 108 of the drum beater assembly 104 onto the drum head 110 of the bass drum 102. Thus, it is noted that by employing the baseplate 100, the pedal clamp 116 can be positioned at any desired point along the length of the lip 182 of the connection plate 176. Further, by utilizing the baseplate 100, (1) the length of the beater shaft 112, and (2) the distance from the striking point of the beater head 108-to-the center of the drum head 110 are adjustable independent from each other.

Further explanation of this issue will now be offered. Note that the two-parameter (x-y) Cartesian coordinates are shown on the drum heads 110 in FIGS. 1 and 6. The x-axis represents the horizontal center line while the y-axis represents the vertical center line. Furthermore, two potential "striking points" labeled point 186 and point 188 are shown on the drum head 110 in both FIGS. 1 and 6. The x-y coordinates of point 186 can be represented by $(x_1,y_1)$ while the x-y coordinates of point 188 can be represented as $(x_2, y_2)$. The length of the beater shaft 112 is vertically adjustable on the drum beater assembly 104. Assume that a certain drum operator prefers the feel of the pedal board 106 when the length of the beater shaft 112 is adjusted to 8". Thus, when the length of the beater shaft 112 measured from the rotating arm 146 (see FIG. 2) to the beater head 108 is 8", the amount of force required to operate the pedal board 106 with the human foot is ideal in the opinion of the drum operator.

A problem that exists with the conventional connection arrangement between the drum beater assembly 104 and the bass drum 102 as shown in FIGS. 1 and 2 is as follows. When the drum operator attaches the pedal clamp 116 of the drum beater assembly 104 to the bass drum 102, and where the desired length of the beater shaft 112 is preset, the distance between the striking point of the beater head 108-to-the center of the drum head 110 is fixed. Consequently, the drum operator does not have any options in selecting another distance between the striking point of the beater head 108 and the center of the drum head 110. This is the case because in the conventional connection arrangement, the length of the beater shaft 112 dictates the y-axis component of the striking point, and the x-axis component which is not adjustable is essentially fixed. Therefore, the x-y components of the striking point are fixed. Thus, once the desired length of the beater shaft 112 is preset, the distance from the striking point of the beater head 108-to-the center of the drum head 110 cannot be changed by the drum operator. Keep in mind that (1) the length of the beater shaft 112 affects the feel of the pedal board 106, and (2) the distance from the striking point of the beater head 108-to-the center of the drum head 110 affects the pitch and amplitude of the acoustic output signal produced.

For arguments sake, assume that the point 186 appearing on the drum head 110 on FIGS. 1 and 6 represents the striking point of the beater head 108 when the length of the beater shaft 112 is 8". Further, assume that the point 186 is 1" from the center of the drum head 110. With this in mind, consider the following as explaining why the distance from the striking point of the beater head 108-to-the center of the drum head 110 is important. The material comprising the drum head 110, for example, mylar, is looser near the center of the drum head 110 than at the edge of the drum head 110. Thus, striking the drum head 110 near the center thereof provides a lower fundamental pitch (lower frequency), while striking the drum head 110 near the edge thereof provides a higher fundamental pitch (higher frequency). Variations of preference of the desired drum pitch of the acoustic output signal by different drum operators requires that the distance from the striking point of the beater head 108-to-the center of the drum head 110 be adjustable.

Different drum operators have different preferences as to what distance between the striking point of the beater head 108 and the center of the drum head 110 sounds best on the bass drum 102. Once the desired fundamental pitch of the acoustic output signal from the bass drum 102 is identified, the locus of points located on the drum head 110 that will provide that fundamental pitch when struck by the beater head 108 can also be identified. This locus of points on the drum head 110 identifies the distance from the striking point of the beater head 108-to-the center of the drum head 110. Consequently, the x-y coordinates of the striking point of the beater head 108 that falls on the locus of points on the drum head 110 must be selected to include the length of the beater shaft 112 (y-axis coordinate) and the lateral adjustment of the drum beater assembly 104 on the baseplate 100 (x-axis coordinate). By utilizing the inventive baseplate 100 for interfacing the drum beater assembly 104-to-the bass drum 102, the striking point of the beater head 108 can be adjusted by laterally shifting the drum beater assembly 104 along the lip 182 of the connection plate 176 and then securing the pedal clamp 116 thereto as shown in FIG. 8.

Now we return to our example of the drum operator who must select the x-y coordinates of the striking point so that the beater head 108 falls onto the locus of points on the drum head 110 to provide the desired fundamental pitch of the acoustic output signal. The drum operator has preset the length of the beater shaft 112 to 8" to provide the desired feel of the pedal board 106. Recall that with the length of the beater shaft 112 of 8", the striking point on the drum head 110 is point 186 {having x-y coordinates $(x_1,y_1)$} which is 1" from the center of the drum head 110 as shown in FIGS. 1 and 6. However, it is discovered that the striking point at point 186 that is 1" from the center of the drum head 110 is not desirable. The drum operator would much prefer the striking point to be 2" from the center of the drum head 110 because that striking point provides an acoustic output signal (percussion sound) that is more desirable. The point 188 shown on the drum head 110 in FIGS. 1 and 6 {and having x-y coordinates ($x_2$, $y_2$)} defines the desired striking point that is 2" from the center of the drum head 110. By utilizing the inventive baseplate 100, the beater head 108 (with the beater length 112 preset at 8") actually strikes the drum head 110 approximately one inch lower than it did without the baseplate 100. This occurs because the inventive baseplate 100 adds approximately one inch to the vertical dimension of the bass drum 102.

Concurrently, the drum operator can laterally shift the pedal clamp 116 of the drum beater assembly 104 by 2" thus obtaining the desired percussion sound characteristics available at the locus of points which are 2" from the center of the drum head 110 while maintaining the length of the beater shaft 112 at 8". This is the striking point located at point 188 shown on the drum head 110 in FIGS. 1 and 6 {and having x-y coordinates ($x_2$, $y_2$)}. As a result of utilizing the inventive baseplate 100, (1) the length of the beater shaft 112 which determines the y-axis coordinate and affects the feel of the pedal board 106, and (2) the distance from the striking point of the beater head 108-to-the center of the drum head 110 which determines the x-axis coordinate and affects the characteristics of the acoustic output signal, are finally adjustable independent of one another. It is noted that the phrase "affects the characteristics of the acoustic output signal" means that the distance from the striking point-to-the center of the drum head 110 affects the percussion sound created by the bass drum 102. Furthermore, the phrase "distance from the striking point of the beater head 108-to-the center of the drum head 110" means a locus of points that are, for example, 2" from the center of the drum head 110. This locus of points would define a concentric circle of points that are equal distant such as, for example, 2" from the center of the drum head 110.

Thus, the baseplate 100 for use with the bass drum 102 includes the center plate 160 having the pair of wing offsets 164. The pair of wings 162 are connected to and extend outwardly from the wing offsets 164 where each of the wings 162 exhibits a curvature for cradling the cylindrical drum shell 118 of the bass drum 102. Further, each of the wings 162 includes at least one penetration such as, for example, slot 166, formed therein for receiving at least one mechanical fastener 122 that extends through the drum shell 118 for adjustably securing each wing 162 to a lug 120 affixed to the drum shell 118. The connection plate 176 is of unitary construction with and extends from the center plate 160 and includes the terminal end 180 with the lip 182 formed thereon. The lip 182 adjustably interfaces with the pedal clamp 116 of the drum beater assembly 104 for connecting the drum beater assembly 104 to the bass drum 102. The pedal clamp 116 is removably connectable to any point along the length of the lip 182 for laterally adjusting the striking point of the beater head 108 of the drum beater assembly 104 on the bass drum 102. The base drum 102 is isolated from the pedal clamp 116 of the drum beater assembly 104 via the isolation medium 168 for improving the resonance performance of the bass drum 102.

The present invention provides novel advantages over other conventional arrangements known in the prior art for connecting the drum beater assembly 104 to the bass drum 102. A main advantage of the baseplate 100 of the present invention for use with a bass drum 102 is that: (1) the baseplate 100 provides lateral placement options for the drum beater assembly 104 wherein the pedal clamp 116 of the drum beater assembly 104 is removably connectable to any point along the lip 182 of the width dimension of the connection plate 176; (2) the baseplate 100 enables the striking point of the beater head 108 on the drum head 110 to be laterally adjusted by adjustably selecting the attachment point of the pedal clamp 116 along the lip 182 of the connection plate 176, an ergonomic advantage; and (3) where the lateral adjustment of the striking point of the beater head 108 on the drum head 110 is independent of the length of the beater shaft 112. The length of the beater shaft 112 determines the y-axis vertical component of the striking point from the center of the drum head 110; (4) the lateral adjustment of the pedal clamp 116, and thus the position of the beater head 108, along the lip 182 of the connection plate 176 is accomplished without changing the length of the beater shaft 112 of the drum beater assembly 104; (5) the lateral adjustment of the position of the beater head 108 along the length of the lip 182 of the connection plate 176 is accomplished without changing the feel of the pedal board 106 of the drum beater assembly 104, i.e., the force required to operate the pedal board 106; (6) the baseplate 100 protects the drum hoop 114 from physical damage that would otherwise be caused by the pedal clamp 116 of the drum beater assembly 104; (7) the inventive baseplate 100 eliminates the necessity for the drum hoop 114 to support the weight of the bass drum 102 resulting in greater resonance of the drum hoop 114; and (8) the baseplate 100 isolates the bass drum 102 from the pedal clamp 116 of the drum beater assembly 104 resulting in improved resonance performance of the bass drum 102 so that the resulting acoustic output signal is not unnecessarily distorted. When the inventive baseplate 100 is utilized, there is no direct surface area contact between the drum beater assembly 104 and the bass drum 102. Further, this isolation of the pedal clamp 116 from the bass drum 102 is accomplished without any addition physical contact between the drum beater assembly 104 and the bass drum 102 when compared to conventional bass drums 102. Finally, by employing the baseplate 100, (9) the length of the beater shaft 112 (which affects the feel of the pedal board 106) and (10) the distance from the striking point of the beater head 108-to-the center of the drum head 110 (which affects the characteristics of the acoustic output signal) are independently adjustable from one another.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A baseplate for use with a bass drum comprising:

a center plate;

a pair of wings extending outwardly from said center plate, each of said wings for cradling and being adjustably secured to a lug affixed to a drum shell of a bass drum; and a connection plate being of unitary construction with and extending from said center plate and having a terminal end with a lip formed thereon, said lip adjustably interfacing with a pedal clamp of a drum beater assembly for connecting said drum beater assembly to said bass drum, said pedal clamp being removably connectable to any point along said lip for laterally adjusting the striking point of a beater head of said drum beater assembly on said bass drum, said bass drum being isolated from said pedal clamp for improving the resonance performance of said bass drum.

2. The baseplate of claim 1 wherein each of said wings includes a suitable curvature for cradling said drum shell of said bass drum.

3. The baseplate of claim 1 wherein said lip comprises a fold formed at a distal end of said terminal end of said connection plate.

4. The baseplate of claim 1 further including an isolation medium positioned between said drum shell and each of said wings for acoustically isolating said wings from said bass drum.

5. The baseplate of claim 1 further including a vertical support positioned between said center plate and said connection plate for aligning said connection plate with said drum beater assembly.

6. A baseplate for use with a bass drum comprising:

a center plate having a pair of wing offsets;

a pair of wings extending outwardly from said wing offsets, each wing for cradling a drum shell of a bass drum and having at least one penetration for adjustably securing said wing to a lug affixed to said drum shell; and a connection plate being of unitary construction with and extending from said center plate and having a terminal end with a lip formed thereon, said lip adjustably interfacing with a pedal clamp of a drum beater assembly for connecting said drum beater assembly to said bass drum, said pedal clamp being removably connectable to any point along said lip for laterally adjusting the striking point of a beater head of said drum beater assembly on said bass drum, said bass drum being isolated from said pedal clamp for improving the resonance performance of said bass drum.

7. The baseplate of claim 6 wherein said penetration formed in each wing comprises at least one slot.

8. The baseplate of claim 6 wherein said penetration formed in each wing comprises at least one hole.

9. The baseplate of claim 6 wherein each wing includes a suitable curvature for cradling said drum shell of said bass drum.

10. The baseplate of claim 6 wherein said lip comprises a fold formed at a distal end of said connection plate.

11. The baseplate of claim 6 further including an isolation medium positioned between said drum shell and each of said wings for acoustically isolating said wings from said bass drum.

12. The baseplate of claim 6 further including a vertical support positioned between said center plate and said connection plate for aligning said connection plate with said drum beater assembly.

13. A drum set for providing a percussion sound comprising:

a bass drum having a drum shell and a drum head;

a drum beater assembly having a pedal clamp and a beater head for striking said drum head; and a baseplate for connecting said drum beater assembly to said bass drum, said baseplate comprising:

a center plate;

a pair of wings extending outwardly from said center plate, each of said wings for cradling and being adjustably secured to a lug affixed to said drum shell of said bass drum; and a connection plate being of unitary construction with and extending from said center plate and having a terminal end with a lip formed thereon, said lip adjustably interfacing with said pedal clamp for connecting said drum beater assembly to said bass drum, said pedal clamp being removably connectable to any point along said lip for laterally adjusting the striking point of said beater head on said drum head, said bass drum being isolated from said pedal clamp for improving the resonance performance of said bass drum.

* * * * *